United States Patent [19]

Flavell et al.

[11] 4,184,678

[45] Jan. 22, 1980

[54] PROGRAMMABLE ACCELERATION EXERCISER

[75] Inventors: Evan R. Flavell, Albany, Calif.; James E. Counsilman, Bloomington, Ind.

[73] Assignee: Isokinetics, Inc., Albany, Calif.

[21] Appl. No.: 808,729

[22] Filed: Jun. 21, 1977

[51] Int. Cl.[2] ..... A63B 21/24

[52] U.S. Cl. ..... 272/129; 272/DIG. 6

[58] Field of Search ..... 73/379; 273/71-73, 273/93, 116, 125, 129, 132, 143, DIG. 5, DIG. 6, DIG. 3; 340/323 R; 128/2.05 R, 2.06 F, 2.06 R

[56] References Cited

U.S. PATENT DOCUMENTS

| | | | |
|---|---|---|---|
| 3,387,493 | 6/1968 | Strittmatter | 272/125 X |
| 3,395,698 | 8/1968 | Morehouse | 272/129 |
| 3,454,942 | 7/1969 | Chamberlin et al. | 340/323 |
| 3,465,592 | 9/1969 | Perrine | 272/125 |
| 3,518,985 | 7/1970 | Quinton | 272/DIG. 6 |
| 3,640,530 | 2/1972 | Henson et al. | 272/125 |
| 3,767,195 | 10/1973 | Dimick | 272/73 |
| 3,784,194 | 1/1974 | Perrine | 272/125 |
| 3,802,698 | 4/1974 | Burian et al. | 128/2.06 F X |
| 3,848,467 | 11/1974 | Flavell | 272/129 X |
| 3,869,121 | 3/1975 | Flavell | 272/129 X |
| 3,874,659 | 4/1975 | Aharoni | 272/129 |
| 3,896,672 | 7/1975 | Henson et al. | 272/125 |
| 3,902,480 | 9/1975 | Wilson | 272/130 |
| 3,998,100 | 12/1976 | Pizatella et al. | 73/379 |
| 4,060,239 | 11/1977 | Pfleiderer | 272/DIG. 6 |

*Primary Examiner*—Vance Y. Hum

*Attorney, Agent, or Firm*—Owen, Wickersham & Erickson

[57] ABSTRACT

An exercising device which yields a variable, programmed speed for regulating the user's movement is disclosed. The device includes a user interfacing device for input of the user's efforts, a variable speed regulator connected to and driven by the interfacing device, a user position sensor also connected to the interfacing device, and a speed programmer connected to both the position sensor and the variable speed regulator. By means of a varying references voltage which it delivers to the speed regulator, the programmer establishes a preselected pattern of varying speed to regulate the user's movement. The user position sensor may take a variety of forms. It may sense the absolute position of the user in the range of motion of the exercise, it may measure the distance of the user from the starting point, or it may calculate the user's position according to time elapsed from the beginning of movement in the exercise.

58 Claims, 7 Drawing Figures

FIG. 1
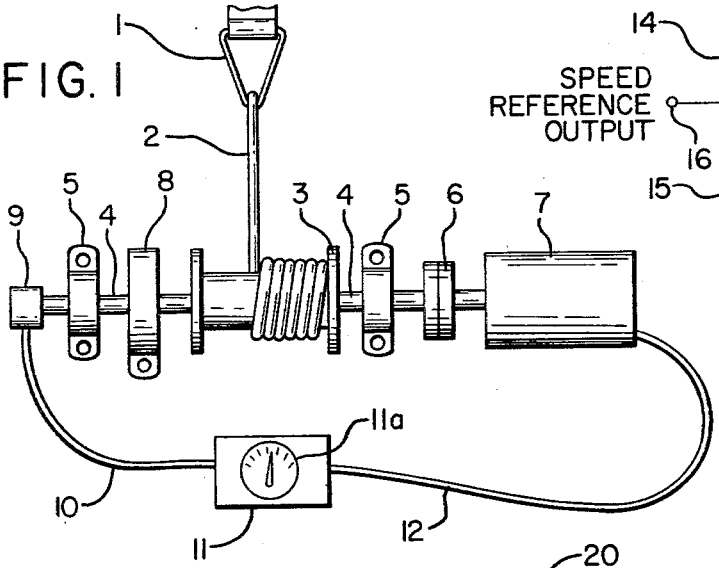
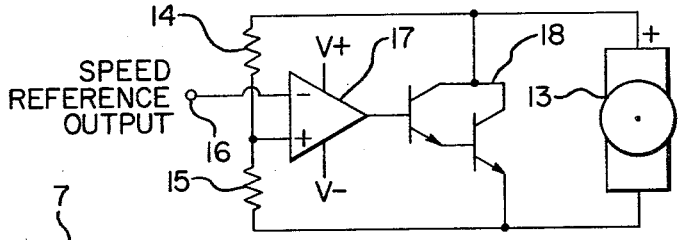
FIG. 2
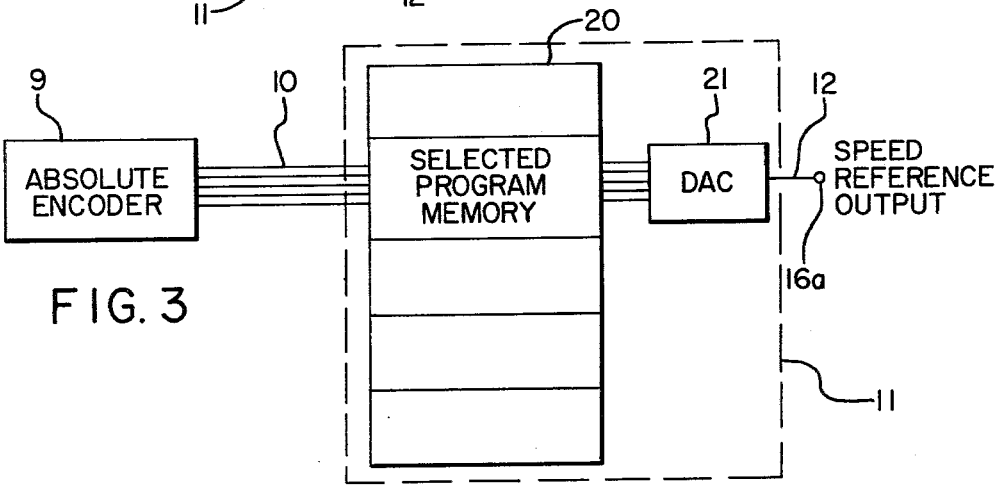
FIG. 3
FIG. 4
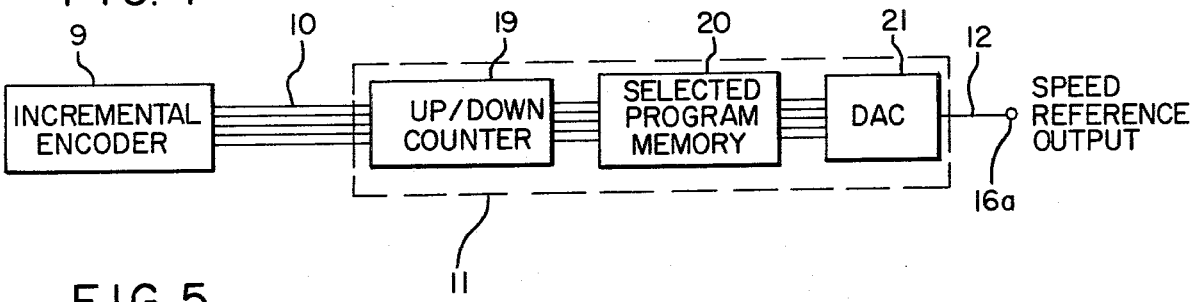
FIG. 5
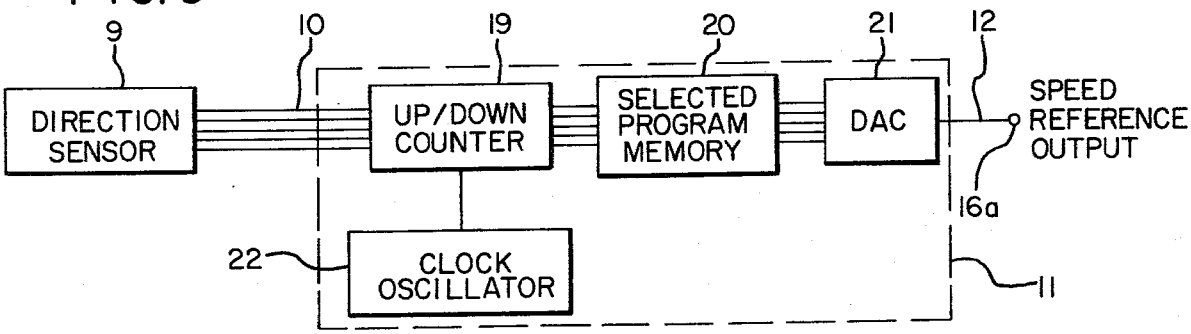

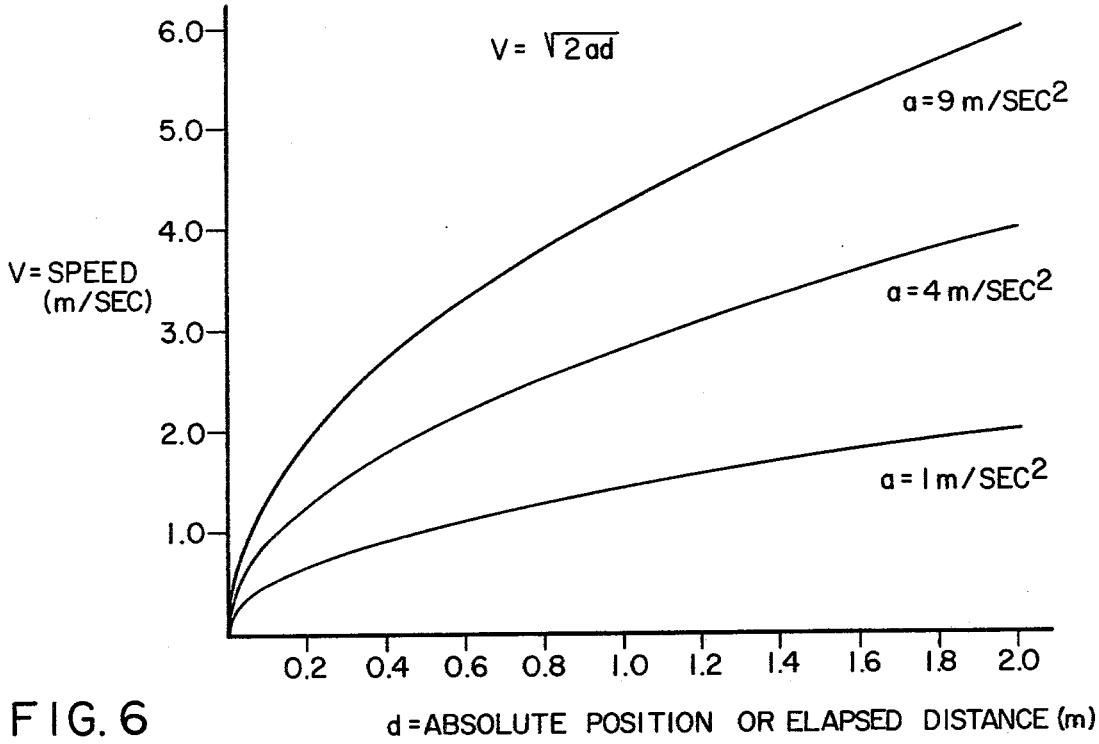
FIG. 6
FIG. 7
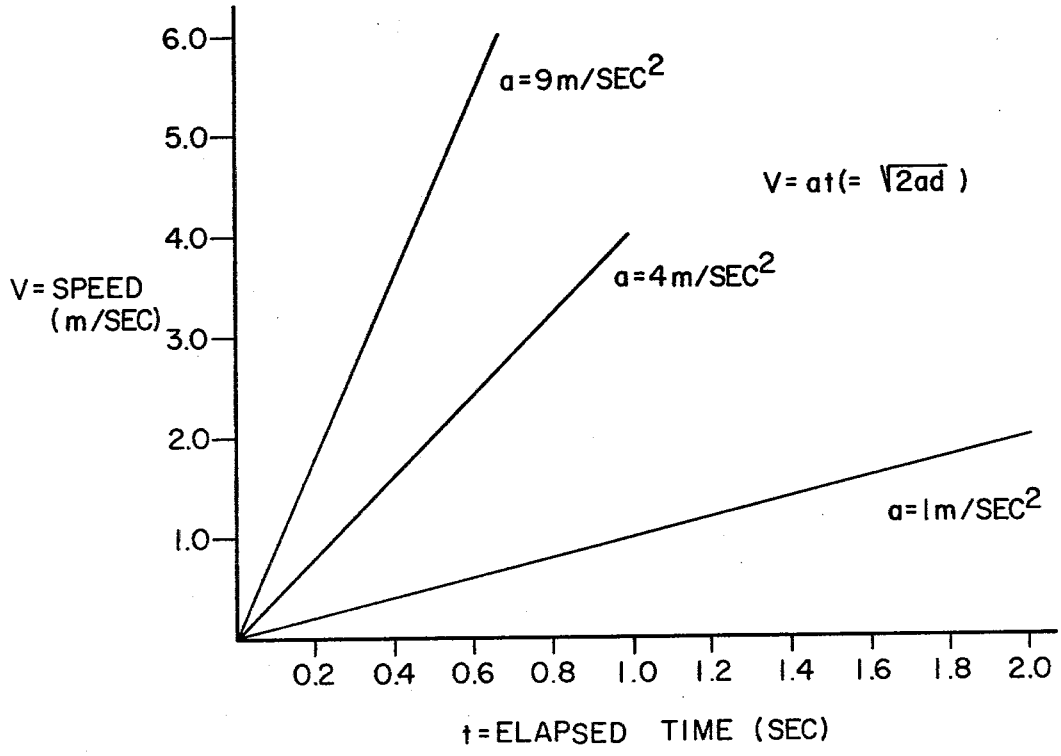

PROGRAMMABLE ACCELERATION EXERCISER

BACKGROUND OF THE INVENTION

The present invention relates generally to speed-regulated exercise apparatus, and more particularly to a device wherein the regulation speed is automatically varied according to a predetermined program.

Recent advancements in the design of exercise apparatus have emphasized the importance of simulating as closely as is practical in exercise the natural movements of the specific activity for which the training is performed, or specificity, as it is called. Exercise apparatus has been devised which closely duplicates the form of such activities as running, jumping, throwing, blocking, swimming, kicking, etc., but in each case, such devices have fallen short of achieving total specificity.

For optimum specificity, an exercise apparatus must not only duplicate the form of the movement, but in addition, it must also reproduce the speed characteristics of the natural activity. Recent research on the specificity of speed in exercise indicates that strength developed in training programs at slow speeds may not be available for use in the higher speed athletic activities for which the training is undertaken. If strength training is to be of maximum benefit in an athletic activity, it must be performed at speeds approximating those encountered in that specific activity.

Speed controlled, or isokinetic, exercise apparatus is well suited to duplicating the speeds typically encountered in athletic activities. In these devices, a dynamic brake mechanism opposes any effort on the part of the exercising user to move the device faster than a preset regulation speed. Throughout virtually the entire range of motion of the exercise, however, the user is limited in his performance to the single present speed, whereas in the performance of actual athletic activities, it is more commonly the case that the speed continuously varies over the range of motion. Few, if any, natural athletic movements are isokinetic in nature.

Thus, while isokinetic exercisers can provide an exercise resistance at speeds typically encountered in athletic activities, they are by definition and by common design practice limited in any single movement, to a narrow range of operation about a single preset regulation speed. Therefore, they cannot provide optimum specificity of speed in athletic training.

U.S. Pat. No. 3,998,100 to Pizatella et al. has suggested the use of computer control to vary and regulate the operating speed of an exercising device. However, the patent did not suggest apparatus or method to accomplish such control. U.S. Pat. No. 3,848,467 to Flavell disclosed a partially programmed exercising apparatus, but only the end points of exercising strokes were subjected to programmed speed control, so that the user did not feel a lack of resistance at the beginning and end points of each stroke. It is a primary object of the present invention to improve upon prior devices in the provision of a speed regulated exerciser wherein a combination of components provides variation in the speed of the exercising stroke through the range of the exercise according to a predetermined program.

SUMMARY OF THE INVENTION

In the present invention, a speed regulator provides exercise resistance against and in proportion to the efforts of the exercising user through a user interface. The regulation speed of the speed regulator is variable and is controlled by a speed programmer which contains a speed program for the range of motion of the exercise. As the user moves the user interface through the range of motion of the exercise, a sensor coupled to the interface commands the speed programmer to execute its speed program. As the speed regulator follows the program being executed, the user, through the user interface, follows the program as well.

The speed programmer executes the speed program according to the position of the user interface, and, therefore, the position of the user, in the range of motion of the exercise. The position of the user interface is directly sensed with an absolute position sensor, or it is derived from either the elapsed time since, or the distance moved from, the beginning of movement in the range of motion.

Variable speed programmable acceleration apparatus and methods which incorporate the structure and techniques described above and which are effective to function as described above constitute the specific objects of this invention.

Other objects, advantages, and features of this invention will become apparent from the following detailed description of a preferred embodiment taken with the accompanying drawings.

BRIEF DESCRIPTION OF THE DRAWINGS

In the Drawings:

FIG. 1 is a schematic view in elevation of a preferred embodiment of the invention.

FIG. 2 is a simplified schematic diagram of a speed regulator included in the apparatus shown in FIG. 1.

FIG. 3 is a block diagram of one embodiment of a speed programmer included in the apparatus shown in FIG. 1.

FIG. 4 is a block diagram of a second embodiment of the speed programmer.

FIG. 5 is a block diagram of a third embodiment of the speed programmer.

FIG. 6 is a graph showing the operating characteristics of the speed programmers of FIGS. 3 and 4 with three representative constant acceleration programs.

FIG. 7 is a graph showing the operating characteristics of the speed programmer of FIG. 5 with three representative constant acceleration programs corresponding in values to those exemplified in FIG. 6.

DESCRIPTION OF A PREFERRED EMBODIMENT

A programmable acceleration exerciser constructed in accordance with one embodiment of the present invention is shown in the schematic view of FIG. 1. Here, a stirrup handle 1 is provided for the exercising user to grip with his hand and which he pulls in any desired manner to obtain exercise from the device. The handle 1 is connected through a cable or other suitable flexible tension line 2 to a rotatable spool 3 about which the cable is wound. The spool 3 is fixedly mounted on a drive shaft 4 which is supported by and free to rotate within bearings 5 which may be of the pillow block type, for example.

The drive shaft 4 is coupled to a variable speed regulator 7 via a one-way clutch 6 such that it is free to rotate in the recoil direction, but is directly coupled to, and transmits rotation to, the variable speed regulator 7 in the opposite, or power direction. Any of a variety of mechanisms well known to those skilled in the art might serve as one-way clutch 6, such as a roller clutch, wrap spring clutch, or dog-and-pawl device (details not shown).

The drive shaft 4 is also connected to a power spring mechanism 8 which functions to constantly urge the drive shaft, and consequently the spool 3, in the recoil direction, thereby winding the cable 2 onto the spool 3 when the user permits recoil. The power spring may include a spiral, helical, or other well-known type torsion spring.

It may be seen that when the exercising user pulls on the handle 1, the cable 2 unwinds from the spool 3 causing it and the drive shaft 4 to rotate in the power direction, which rotation is transmitted through the one-way clutch 6 to the variable speed regulator 7. When the user ceases to pull on the handle, the power spring mechanism 8 causes the drive shaft 4 and spool 3 to rotate in the opposite direction, recoiling the cable onto the spool. Rotation in the recoil direction, however, it not transmitted to the variable speed regulator 7.

Also coupled to the drive shaft 4 is a sensor 9 which connects via wires 10 to a speed programmer 11. The speed programmer 11 is connected to the variable speed regulator 7 via wires 12. The functions of the sensor 9 and the speed programmer 11 will be more fully described below with reference to FIGS. 3,4 and 5.

To those skilled in the art, many mechanisms are known which might be employed as the variable speed regulator 7, such as the mechanical and hydraulic devices described in U.S. Pat. Nos. 3,465,592 and 3,784,194 to J. J. Perrine, the centrifugal governor devices of U.S. Pat. Nos. 3,640,530 and 3,896,672 to Henson et al, or the electronic and electromechanical servo systems shown in Wilson U.S. Pat. No. 3,902,480 and Flavell U.S. Pat. Nos. 3,848,467 and 3,869,121.

In this embodiment of the present invention, the variable speed regulator 7 consists of a direct current generator operated as a dynamic brake by electronic control circuitry. Details of the construction of the variable speed regulator 7 are shown in the schematic diagram of FIG. 2.

Here, the direct current generator 13, driven by the drive shaft 4 of FIG. 1 through the one-way clutch 6 of FIG. 1, generates a voltage output proportional to its speed of rotation. As its speed of rotation and consequent output voltage approach a value such that the proportion of the output voltage established by the voltage divider made up of resistors 14 and 15 exceeds the speed reference voltage of a speed reference input 16, the amplifier 17 turns on and begins supplying current to a variable shunt element 18, which may comprise Darlington connected power transistors. Power to the amplifier 17 may be provided at V+ and V− via any of several means well known to those skilled in the art, such as from a line-operated low voltage power supply or battery (not shown), or it may be supplied from the generator 13. Electrical power as required by other system components may be supplied in a similar manner.

It may be seen that any increase in speed of rotation of the generator 13 above that corresponding to a voltage output in fixed proportion to that of the speed reference voltage can only occur via overcoming a proportional increase in the dynamic braking forces of the generator 13. These dynamic braking forces result from the consequential increase in current flow in the armature of the generator, since the variable shunt element 18 maintains a generator output voltage substantially in accordance with the speed reference voltage. This dynamic braking effect is characterized by the regulation constant $R_g$ of the particular generator used:

$$R_g = \Delta n/\Delta T = R_a/(K_E K_T)$$

where:

n = rotational speed,

T = torque, $R_a$ = armature resistance of the generator, $K_E$ = voltage constant of the generator, and $K_T$ = torque constant of the generator.

Thus, the components indicated in FIG. 2 regulate the speed of the exercise apparatus by increasing and decreasing the dynamic braking forces in opposition to and in proportion to user induced speed variations about the regulation speed established by the speed reference voltage. The accuracy of the regulation provided by this embodiment of the variable speed regulator 7 is a function of the regulation constant $R_g$ of the generator 13 used therein. Where more accurate regulation is desired, other servo regulator systems may be incorporated, such as shown in Flavell U.S. Pat. No. 3,869,120, or such as are otherwise well known to those skilled in the art.

The speed reference voltage is communicated to the variable speed regulator 7 by the wires 12 of FIG. 1. This speed reference voltage is generated by the speed programmer 11 which functions to control the magnitude of the speed reference voltage, thereby to control the regulation speed of the variable speed regulator 7 and the speed of the exercise apparatus. The speed is controlled in the sense that the exercising user encounters an increasing level of generator resistance in opposition to any effort he may apply to cause the device to exceed the varying speed which follows the speed program. Of course, if in the program an abrupt decrease in speed, for example, is provided for at a particular point, the user will encounter an abrupt increase in the resistance level at that point and will, in effect, be forced to slow down to the new prescribed speed level.

It may be seen that the accuracy with which the user is forced to follow the predetermined program is a function of the accuracy of the speed regulator. With an ideal regulator, wherein a very small deviation in speed from the speed reference value produces a very large increase in resistance, the user precisely follows the speed characteristic programmed for the exercise. However, it may be desirable, for some types of exercising, to provide a regulator which is not "ideal". For example, a generator which permits relatively wide deviations from the reference speed, but with corresponding variations in resistance according to the magnitude of the speed deviation, could be used for some types of exercising device. With this type regulator the actual speed of the exercise, at any given point, may be at the program speed or below or above it, depending on the user's strength and effort. The invention encompasses exercising apparatus utilizing either type of regulator—one providing nearly absolute resistance to any deviation above the program speed, and one providing resistance to such deviation only in relation to the degree of the deviation. The speed programming function may be accomplished via several means, three of which are shown in the different embodiments of the speed programmer 11 of FIGS. 3, 4, and 5, respectively.

FIG. 3 shows the sensor 9, which is drivingly connected to the drive shaft 4 as shown in FIG. 1. This sensor 9 comprises an absolute position encoder which develops a coded digital output corresponding to the position of the drive shaft. The sensor 9 develops a different digital output for each of a finite number of positions of the drive shaft corresponding to the position of the apparatus and the user in the range of motion of the exercise being performed. The sensor may include, for example, a potentiometer driving an analog to digital converter (not shown), or an optical or mechanical shaft position encoder of a commonly available manufactured type. The digital output signal of the sensor 9 is conducted to the speed programmer 11 via the wires 10.

The speed programmer 11 comprises a program memory 20, or a selected program memory 20 from a series of alternative memories as indicated, and a digital-to-analog converter 21. The program memory 20 may be of the integrated circuit ROM, PROM, RAM, or EAROM type, for example, and may be programmed via means well known to those skilled in the art.

The program memory 20 is programmed to contain coded information relating each digital output position signal of the sensor 9 to a specific speed reference voltage value, also in digital form, which is translated into an analog speed reference voltage at the speed reference output 16*a* by the digital-to-analog converter 21. For example, to take a highly simplified illustration, the program memory contents may include a "look-up table" for the function:

$$V=\sqrt{2ad}$$

where:

V = velocity (reference speed corresponding to reference voltage value), a = a desired constant acceleration rate, and d = distance from the starting point.

Such a table might include, for example, data for 40 discrete positions in a 2 meter range of motion of an exercise, for each of three representative constant acceleration rates, as graphed in FIG. 6.

In this instance, as the exercising user moves the apparatus through the range of motion of the exercise, the absolute encoder sensor 9 sequentially addresses the 40 memory locations which contain coded speed reference voltage values, each corresponding to a reference speed which in turn corresponds to the user position (distance) according to the above equation. The digital-to-analog converter 21 translates this sequence of speed reference voltage values into a stepwise varying analog speed reference voltage according to this program.

As the reference speed of the apparatus is controlled by the speed reference voltage, it may be seen that the position of the user and apparatus in the range of motion of the exercise controls the reference speed of the apparatus at that position, and as the apparatus is moved through the range of motion of the exercise, the reference speed is automatically varied according to the operating characteristics shown in the graph of FIG. 6, reflecting constant acceleration through the range of motion.

A constant rate of acceleration program is described here for illustrative purposes only. Any desired constant, varying linear, or non-linear acceleration function may be programmed into the selected program memory 20 for execution according to the absolute position of the apparatus, and the speed and acceleration characteristics of any desired exercise movement may be precisely controlled. A selected program may include both increases and decreases in reference speed. Thus, these elements of natural athletic movements may be accurately duplicated.

The speed programmer 11 may contain multiple program memories 20, as indicated in FIG. 3, or multiple programs within a single large memory, which may be selected by a selector switch 11*a* shown in FIG. 1, such that any one of several different speed programs may be selected, as, for example, to permit the performance of several different exercises, or several different forms of the same exercise, on a single device. In the example of FIG. 6, it may be seen that any one of three linear acceleration constants might be selected in this manner.

It may be seen that, where a single program only is required, and the sensor 9 is an absolute encoder as in this embodiment, the program memory 20 may actually be contained in the encoding of the sensor 9 itself, which may then directly drive the digital-to-analog converter 21 to generate the programmed speed reference voltage. Also, where the desired acceleration characteristics of an exercise may be defined by a mathematical function of the position of the apparatus, as is the case in the constant acceleration example of FIG. 6, that mathematical function may be contained as a program in the program memory, and additional computational circuitry may be incorporated to convert the position signal of the sensor 9 directly into a speed reference voltage value. These and other modifications of the means of the present embodiment for sensing the position of the apparatus and translating such information into a programmable speed reference will be apparent to those skilled in the art and may be equally suited to the performance of these functions in specific applications of this invention.

In the embodiment of FIG. 4, the sensor 9 is a bidirectional incremental encoder which, via the wires 10 connects to an drives and up/down counter 19 functioning as an accumulator. When the sensor 9 senses movement of the apparatus in the power direction, it advances the up/down counter upward one count for each increment of movement, which corresponds to a known distance of movement on the part of the user in the range of motion of the exercise. Similarly, when the sensor 9 senses movement in the recoil direction, it advances the up/down counter 19 downward one count for each increment of movement. The output of the up/down counter 19, which addresses the program memory 20, therefore corresponds to a position of the apparatus and of the exercising user in the range of motion of the exercise, and the program memory 20 and digital-to-analog converter 21 function to generate a programmed speed reference voltage as in the embodiment of FIG. 3.

As the output of the up/down counter 19 of FIG. 4 is analogous to the output of the absolute encoder sensor 9 of FIG. 3, the constant acceleration program example of FIG. 6 may be similarly implemented in the program memory and executed. Here again, the program memory 20 preferably comprises multiple and selectable memories or portions thereof (only the selected memory 20 being shown in FIG. 4), and the program memory may actually be implemented within the encoding of the incremental encoder sensor 9 itself, or mathematically definable programs may be executed via additional computational means, without departure from the scope of the present invention.

In FIG. 5, the sensor 9 is a simple direction sensor which generates a different signal depending upon whether the apparatus is moved in the power or the recoil direction. This signal is carried via the wires 10 to an up/down counter 19, which counts up at the rate established by a clock oscillator 22 when the signal indicates movement in the power direction, and which counts down when the signal indicates movement in the recoil direction. The output of the up/down counter 19, which addresses the program memory 20, therefore corresponds to a desired position of the apparatus and of the exercising user in the range of motion of the exercise, depending upon the contents of the program memory 20, and the program memory 20 and the digital-to-analog converter 21 function to generate a programmed speed reference voltage which varies as a function of elapsed time.

Again, for example, a constant acceleration program for the range of motion of the exercise may be implemented. Here, the program memory contents would include a "look-up table" for the function:

$$V=at$$

where:

V=velocity (speed reference voltage value),
a=a desired constant rate of acceleration, and
t=elapsed time This function is graphed in FIG. 7 for the same three exemplary rates of acceleration illustrated in the speed vs. distance curves of FIG. 6. If the exercising user follows precisely the reference speed for which the apparatus is programmed, the reference speed vs. distance curves for these functions would be as shown in FIG. 6, since for a constant rate of acceleration, $V=at=\sqrt{2ad}$. The program memory in this embodiment contains information correlating reference speed values with increments of elapsed time, rather than distance moved.

As the exercising user moves the apparatus through the range of motion of the exercise in the power direction, the up/down counter increments upward as time elapses, sequentially addressing the proper memory locations of the program memory 20. The contents of the program memory 20, then, being the desired speed reference voltage values, are converted by the digital-to-analog converter 21 into a stepwise incrementing analog speed reference voltage according to the program.

Again, a constant rate of acceleration program is described here for illustrative purposes only. Any desired constant, varying linear, or non-linear function may be programmed into the program memory for execution according to the time elapsed in the exercise movement. Multiple and selectable memories of portions thereof, or computational components, as described above, may be incorporated as desired. In this embodiment, using the up/down counter 19 itself as the program memory 20 results directly in a constant acceleration program, the rate of which may be varied by varying the frequency of the clock oscillator 22.

At the end of the range of motion of the exercise, with reversal of direction of motion to the recoil direction, the up/down counter 19 counts down to zero and the apparatus is ready to begin program execution for the next repetition of the movement. The frequency of the clock oscillator 22 may be increased during movement in the recoil direction to provide a rapid count down, or the up/down counter 19 may be reset to the desired starting point by the direction signal of the direction sensor 9.

Thus, any of the embodiments of FIGS. 3, 4 or 5 may be utilized to program the speed of an exercise according to the position of the exercising user in the range of motion of the exercise, and, with a suitable program contained therein, the speed programmer may very precisely duplicate the speed and acceleration characteristics of specific natural athletic movements.

If desired, the exercising system may include a performance display readout as disclosed in Flavell U.S. Pat. No. 3,848,467.

Many and varied applications of this programmable acceleration exerciser will be apparent to those skilled in the art. For example, it might be easily adapted to simulate throwing movements with the exerciser apparatus mounted at a suitable height on a wall, and the user standing with his back to the apparatus. Having preselected a desired acceleration program for the range of motion of the exercise with the selector switch 11*a*, the user would grip the handle 1 and pull on the cable 2, moving his arm in a manner similar to that of throwing the baseball, or shot, or javelin, for example. It may be seen that the speed program and apparatus positioning are easily adapted to accomodate different types of throwing movements.

As the exercising user begins to move the device, the sensor 9 causes the speed programmer 11 to execute the preselected program, and the speed reference voltage is varied accordingly. Depending upon the program memory contents of the speed programmer 11, the speed reference voltage might be programmed to start at the beginning of the movement near zero and then increase linearly with time throughout the full range of motion of the throwing movement. As any effort on the part of the user to exceed the speed established by the speed reference voltage is opposed by the dynamic braking force of the speed regulator 7, the apparatus provides an exercise resistance proportioned to the user's efforts to exceed the programmed speed at any given point. The user is therefore encouraged to follow the speed program throughout the range of motion of the exercise.

It may be seen here that various programs can and should be used as necessary for differing exercise objectives. The optimum program for a faster baseball pitch, for example, might be entirely different from that for a longer javelin toss. Optimum programs could include deceleration as well as acceleration in the range of motion, as for example may be appropriate to certain complex movements, or to the "follow-through" portions of these and other movements. Also, series of programs may be developed for specific exercises such that an athlete may be gradually trained through accomodation to a desired optimum performance pattern.

At the end of the exercise movement, the user relaxes and allows the power spring 8 to recoil the cable 2 onto the spool 3. As the one-way clutch 6 is disengaged from the speed regulator 7 in the recoil direction of movement, the recoil may occur at any speed allowed by the user. During the recoil, the sensor 9 commands the speed programmer 11 to reset to the start of the program, and when the recoil is completed, both the user and the exerciser are ready to repeat the exercise. The movement may then be repeated as many times as desired, or as is directed by the coach or trainer to achieve the training objectives.

As shown in the embodiments of FIGS. 3, 4 and 5, the speed program of the apparatus may be controlled by the absolute position of the apparatus, the distance moved by the apparatus, or by the time in motion of the apparatus. As different programs are required to achieve the same speed variation over the range of motion of an exercise with these methods, one or another of them may be found to be better suited to a particular type of exercise. It will also be apparent to those skilled in the art that although preferred forms of the invention are shown and described, alternative programming means may also be suited to the purpose of varying the speed of the apparatus through the range of motion of an exercise. For example, mechanical or hydraulic systems incorporating programming cams might be suitable.

In the described embodiments of the invention, a handle 1, cable 2, and spool 3 are employed to transmit the forces exerted by the user through the clutch 6 to the speed regulator 7. It will be apparent to those skilled in the art that alternative interfacing means of force transmission such as levers, etc., may also be suitable in some applications to the purpose of translating exercise movements into system movement. It may also be seen that in certain configurations, a powered recoil such as provided by the power spring 8 may not be required, as, for example, would occur via gravity acting upon the user or the user interface and returning the apparatus to a starting position after the completion of a movement, or as would occur in continuous movements where no recoil at all would be required.

The following advantages are among those obtained by the present invention:

(1) Complexly varying speeds and accelerations commonly encountered in natural athletic activity may ve precisely duplicated in exercise, giving maximum specificity and transfer of training effectiveness to athletic activities.

(2) The performance characteristics of the apparatus, being accurately controlled, are repeatable among users and training sessions. With conventional exercise apparatus, considerable attention on the part of both the user and his supervisor is required to assure uniform and proper performance. The present invention is effective to substantially eliminate such variability.

(3) A single apparatus may be adapted to a variety of highly specialized exercises via simple program memory changes, or via selection among multiple programs. Previously, multiple devices were required to achieve this versatility.

(4) Through gradual modification of programs, athletes may be adaptively trained to perform movements in an optimum manner, and deviations from optimum performance may thereby be corrected. Previously, apparatus having the level of precision and control necessary to accomplish this was not available.

(5) In combination with suitable performance readout displays, athletes' performance abilities as related to specific movement programs may be analyzed, thereby permitting differentiation among athletes' suitabilities for particular types of activities. Such aptitude assessment was heretofore a difficult and highly subjective matter.

(6) The preferred combination of components for accomplishing these objectives is neither complex nor expensive to manufacture.

To those skilled in the art to which this invention relates, these and other advantages of this programmable acceleration exerciser will be apparent. Many changes in construction and widely differing embodiments and applications will suggest themselves without departing from the spirit and scope of the invention. The disclosures and the description herein are purely illustrative and are not intended to be in any sense limiting.

We claim:

1. A totally speed programmable exercise device comprising:

a user interface means for accepting user input exercising movement;

speed regulation means connected to the user interface means for substantially limiting the speed of user movement to a variable speed reference value; and program means, including a predetermined program for controlling the speed regulation means throughout an entire exercise stroke and addressing means for accessing locations on said predetermined program for establishing a series of many points within the exercise stroke, operably associated with the user interface means for automatically varying said speed reference value at any point of the series of points throughout the range of motion of each exercise stroke;

whereby through each of the user's exercise strokes, he experiences a speed of movement which varies according to a predetermined program.

2. The exercising device of claim 1 wherein said program means includes a plurality of separately selectable programs, each controlling the entire duration of an exercise stroke, and means for selecting any one of the programs for use in an exercise.

3. The exercising device of claim 1 wherein said program means includes means for sensing the position of the user interface means, and means responsive to the position of the user interface means throughout each exercise stroke for controlling the speed reference value.

4. The exercising device of claim 3 wherein said sensing means comprises an absolute position encoder.

5. The exercising device of claim 3 wherein said controlling means includes means for measuring the distance moved by the user interface means throughout each exercise stroke from a reference position, and translation means for converting the distance moved into a user interface position value.

6. The exercising device of claim 5 wherein said measuring means comprises an incremental encoder, and said conversion means includes an accumulator for accumulating increments of motion of the user interface means.

7. The exercising device of claim 6 wherein said accumulator comprises a counter.

8. The exercising device of claim 3 wherein said controlling means includes means for detecting initiation of motion of the user interface means, means for timing the elapsed time since initiation of the motion of the user interface means, and means for converting throughout each exercise stroke the elapsed times into user interface position values.

9. The exercising device of claim 8 wherein said timing means includes a clock oscillator, and said converting means includes an accumulator for accumulating increments of elapsed time in motion of the user interface means.

10. The exercising device of claim 9 wherein said accumulator comprises a counter.

11. The exercising device of claim 1 wherein said program means includes timing means for providing a varying signal corresponding to a series of increments of elapsed time in motion of the user interface, and means responsive to said elapsed time signal for controlling the speed reference value at each increment.

12. The exercise device of claim 1 wherein said user input interface means includes:

a rotatable portion, and a rotatably mounted shaft providing a mount for said rotatable portion, said shaft being drivingly connected to the speed regulation means.

13. The device of claim 12 wherein said rotatable portion of said user input interface comprises one or more spools connected to and receiving windings of flexible tension line for accepting user input exercising movement.

14. The device of claim 1 wherein said user input interface means includes a one-way clutch for drivingly connecting the user input to the speed regulation means in one direction of movement of an exercising stroke and for disengaging the user input from the speed regulation means in the reciprocal direction of movement.

15. The device of claim 14 wherein said user input interface means further includes recoil means to urge the user input interface means toward said disengaged direction of movement.

16. The exercising device of claim 1 wherein said speed regulation means includes:

variable resistance means for opposing user input forces applied to said user input interface means, means for determining the difference between the speed of the user input interface and the speed reference value, and means for controlling said variable resistance means according to said difference between the speed of the user input interface and the speed reference value.

17. The device of claim 16 wherein said variable resistance means comprises an electrical generator and means for loading the electrical output of said generator, and said controlling means includes means for varying said electrical load.

18. A speed programmed exercise device comprising:

a user interface means for accepting user input exercising movement;

speed regulation means connected to the user interface means for substantially limiting the speed of user movement to a variable speed reference value; and program means operably associated with the user interface means for varying said speed reference value through the range of motion of the exercising stroke;

said program means including a preprogrammed memory storing a series of speed reference values corresponding to values of user interface position, and means for addressing said memory to select a speed reference value according to the user interface position, whereby through the user's exercising stroke, he experiences a speed of movement which varies according to a predetermined program.

19. The device of claim 18 wherein the preprogrammed memory comprises an electronic digitally encoded storage element.

20. The device of claim 19 wherein the program means further includes digital to analog conversion means for converting digitally encoded memory contents into an analog speed reference value.

21. A speed programmed exercise device comprising:

a user interface means for accepting user input exercising movement;

speed regulation means connected to the user interface means for substantially limiting the speed of user movement to a variable speed reference value; and program means operably associated with the user interface means for varying said speed reference value through the range of motion of the exercising stroke;

said program means including controlling means responsive to the elapsed time in motion of the user interface for controlling the speed reference value, said controlling means having timing means for providing a varying signal corresponding to elapsed time in motion of the user interface, said timing means including a clock oscillator for encoding increments of time in motion of the user interface means, and means for accumulation of encoded increments of time from the clock oscillator and for encoding therefrom an elapsed time of movement of the user interface;

whereby through the user's exercising stroke, he experiences a speed of movement which varies according to a predetermined program.

22. The device of claim 21 wherein said accumulation means is a counter.

23. A speed programmed exercise device comprising:

a user input interface means for accepting user input exercising movement;

speed regulation means connected to the user interface means for substantially limiting the speed of user movement to a variable speed reference value;

said user input interface means including a one-way clutch for drivingly connecting the user input to the speed regulation means in one direction of movement of an exercising stroke and for disengaging the user input from the speed regulation means in the reciprocal direction of movement and further includes recoil means to urge the user input interface means toward said disengaged direction of movement, said recoil means comprising a power spring; and program means operably associated with the user interface means for varying said speed reference value through the range of motion of the exercising stroke;

whereby through the user's exercising stroke, he experiences a speed of movement which varies according to a predetermined program.

24. A speed programmed exercise device comprising:

a user interface means for accepting user input exercising movement;

speed regulation means connected to the user interface means for substantially limiting the speed of user movement to a variable speed reference value and including variable resistance means for opposing user input forces applied to said user input interface means, difference-determining means for determining the difference between the speed of the user input interference and the speed reference value, and control means for controlling said variable resistance means according to the difference between the speed of the user input interface and the speed reference value, said control means comprising:

an electrical generator, electrical loading means for loading the electrical output of said generator, means for varying said electrical load, comprising one or more power semiconductors connected across the output of said electrical generator, and driving circuitry connected to said power semiconductors responsive to the difference between a value proportional to the generator output voltage and the speed reference value, and program means operably associated with the user interface means for varying said speed reference value through the range of motion of the exercising stroke;

whereby through the user's exercising stroke, he experiences a speed of movement which varies according to a predetermined program.

25. A totally speed programmable exercising device, comprising:

a user interface means for accepting user input exercising movement, speed regulation means connected to the user interface means for substantially limiting the speed of user movement to a variable speed reference value;

sensor means operably associated with the user interface means for determining the position of the interface means and therefore of the exercising user in the range of motion of the exercise stroke, and for providing a varying signal corresponding to the sensed position; and program means, including a predetermined program for controlling the speed regulation means throughout an entire exercise stroke and addressing means for accessing locations on said predetermined program for establishing a series of many points within the exercise stroke, connected to the sensor means and to the speed regulation means providing means for receiving the varying signal of the sensor means and for converting it into a corresponding speed reference value which varies at any point of the series of points throughout the range of motion of each exercise stroke, and for transmitting said speed reference value to said speed regulation means;

whereby, through each of the user's exercise strokes, he experiences a speed of movement which varies according to a predetermined program.

26. A totally speed programmable exercising device, comprising:

a user input interface means for accepting user exercising movement;

speed regulation means connected to the user interface means for substantially limiting the speed of user movement to a variable speed reference value;

timing means operably associated with the user interface means for determining the elapsed time in motion of the interface means in an exercise stroke, and for providing a signal corresponding to said elapsed time; and program means, including a predetermined program for controlling the speed regulation means throughout an entire exercise stroke and addressing means for accessing locations on said predetermined program for establishing a series of many points within the exercise stroke, connected to the timing means and to the speed regulation means providing means for receiving the varying signal of the timing means and for converting it into a corresponding speed reference value, which varies at any of the series of points throughout the range of motion of each exercise stroke, and for transmitting said speed reference value to said speed regulation means;

whereby, through each of the user's exercise strokes, he experiences a speed of movement which varies according to a predetermined program.

27. A totally speed programmable exercising device, comprising:

a user input interface means for accepting user exercising movement;

speed regulation means connected to the user interface means for substantially limiting the speed of user movement to a variable speed reference value;

measurement means operably associated with the user interface means for continuously determining the distance moved by the interface means and therefore by the exercising user in the range of motion of the exercising stroke, and for providing a signal corresponding to the measured distance; and program means, including a predetermined program for controlling the speed regulation means throughout an entire exercise stroke and addressing means for accessing locations on said predetermined program for establishing a series of many points within the exercise stroke, connected to the measurement means and to the speed regulation means providing means for receiving the varying signal of the measurement means and for converting it into a corresponding speed reference value, which varies at any point of the series of points throughout the range of motion of each exercise stroke, and for transmitting said speed reference value to said speed regulation means;

whereby, through each of the user's exercise strokes, he experiences a speed of movement which varies according to a predetermined program.

28. A totally speed programmable variable speed exercising device comprising:

a user interface means for accepting user input exercising movement;

variable resistance means connected to the user interface means, for providing a variable resistance to user movement, said resistance increasing with speed above a variable speed reference value; and program means operably associated with the user interface means, and including means for providing a predetermined program for controlling the variable resistance means throughout an entire exercise stroke and addressing means for accessing locations in said predetermined program for establishing a series of many points within the exercise stroke, for automatically varying said speed reference value at any point of the series of points throughout the range of motion of each exercise stroke, whereby, through each of the user's exercise stroke, he experiences a speed of movement which varies according to a predetermined program, and according to the amount of force he applies to said user interface means.

29. The exercising device of claim 28 wherein said program means includes a plurality of separately selectable programs, each controlling the entire duration of an exercise stroke, and means for selecting any one of the programs for use in an exercise.

30. The exercising device of claim 28 wherein said program means includes means responsive to the position of the user interface means, in the range of motion of each exercise stroke, for controlling the speed reference value.

31. The exercising device of claim 30 wherein said controlling means includes an absolute position encoder for sensing the position of the user interface means.

32. The exercising device of claim 30 wherein said controlling means includes means for measuring the distance moved by the user interface means throughout each exercise stroke from a reference position, and means for converting the distance moved into a user interface position value.

33. The exercising device of claim 32 wherein said measuring means comprises an incremental encoder, and said converting means includes means for accumulating increments of motion of the user interface.

34. The exercising device of claim 33 wherein said accumulating means comprises a counter.

35. The exercising device of claim 30 wherein said controlling means includes means for detecting initiation of motion of the user interface means, means for measuring the elapsed time in motion of the user interface means, and means for converting throughout each exercise stroke the measured elapsed times into user interface position values.

36. The device of claim 28 wherein said program means includes timing means for providing a varying signal corresponding to the elapsed time in motion of the user interface means, and means responsive to said elapsed time signal for controlling the speed reference value.

37. The exercise device of claim 28 wherein said user interface means includes a rotatable portion, and a rotatably mounted shaft providing a mount for said rotatable portion, said shaft being drivingly connected to the variable resistance means.

38. The device of claim 37 wherein said rotatable portion of said user interface means comprises a spool connected to and receiving windings of flexible tension line for accepting user input exercising movement.

39. The device of claim 28 which further includes a one-way clutch drivingly connecting the user interface means to the variable resistance means in one direction of movement of an exercising stroke and for disengaging the user interface means from the variable resistance means in the opposite direction of movement.

40. The device of claim 39 wherein said user interface means further includes recoil means urging the user interface means toward said opposite direction of movement.

41. The exercising device of claim 28 wherein said variable resistance means includes an electrical generator, means for supplying an electrical load to the output of the generator, and control means for varying the electrical load.

42. A variable speed exercising device comprising:

a user interface means for accepting user input exercising movement;

variable resistance means connected to the user interface means, for providing a variable resistance to user movement, said resistance increasing with speed above a variable speed reference value; and program means operably associated with the user interface means for varying said speed reference value through the range of motion of the exercising stroke, said program means including controlling means responsive to the position of the user interface means, in the range of motion of the exercising stroke, for controlling the speed reference value, said controlling means including means for detecting motion of the user interface means, time measuring means for measuring the time in motion of the user interface means, and converting means for converting the measured time in motion of the user interface means into a user interface position value, said time measuring means including a clock oscillator, and said converting means including an accumulator for accumulating increments of time in motion of the user interface means, whereby, through the user's exercising stroke, he experiences a speed of movement which varies according to a predetermined program, and according to the amount of force he applies to said user interface means.

43. A variable speed exercising device comprising:

a user interface means for accepting user input exercising movement;

variable resistance means connected to the user interface means, for providing a variable resistance to user movement, said resistance increasing with speed above a variable speed reference value; and program means operably associated with the user interface means for varying said speed reference value through the range of motion of the exercising stroke, said program means including a preprogrammed memory storing a series of speed reference values corresponding to values of user interface position, and means for addressing said memory to select a speed reference value according to the user interface position, whereby, through the user's exercising stroke, he experiences a speed of movement which varies according to a predetermined program, and according to the amount of force he applies to said user interface means.

44. The device of claim 43 wherein the preprogrammed memory comprises an electronic digitally encoded storage element.

45. The device of claim 44 wherein the program means further includes, digital to analog conversion means for converting digitally encoded memory contents into an analog speed reference value received by said variable resistance means.

46. A variable speed exercising device comprising:

a user interface means for accepting user input exercising movement;

variable resistance means connected to the user interface means, for providing a variable resistance to user movement, said resistance increasing with speed above a variable speed reference value; and program means operably associated with the user interface means for varying said speed reference value through the range of motion of the exercising stroke, said program means including controlling means responsive to the elapsed time in motion of the user interface means for controlling the speed reference value, said controlling means including timing means for providing a varying signal corresponding to the elapsed time in motion of the user interface means, said timing means including a clock oscillator for encoding increments of time of movement of the user interface means, and means for accumulating encoded increments of time and for encoding therefrom an elapsed time of movement of the user interface means, whereby, through the user's exercising stroke, he experiences a speed of movement which varies according to a predetermined program, and according to the amount of force he applies to said user interface means.

47. A variable speed exercising device comprising:

a user interface means for accepting user input exercising movement;

variable resistance means connected to the user interface means, for providing a variable resistance to user movement, said resistance increasing with speed above a variable speed reference value, said variable resistance means including an electrical generator, load supplying means for supplying an electrical load to the output of the generator, and control means for varying the electrical load, said load supplying means comprising one or more power semiconductors connected across the output of said electrical generator, and said control means including means for determining the difference between a value proportional to the generator output voltage and the speed reference value, and driving circuitry connected to said power semiconductors responsive to said difference, program means operably associated with the user interface means for varying said speed reference value through the range of motion of the exercising stroke, whereby, through the user's exercising stroke, he experiences a speed of movement which varies according to a predetermined program, and according to the amount of force he applies to said user interface means.

48. A totally speed programmable variable speed exercising device, comprising:

a user interface means for accepting user input exercising movement;

variable resistance means connected to the user interface means, for providing a variable resistance to user movement, said resistance increasing with speed and varying with a speed reference value;

sensor means operably associated with the user interface means for determining the position of the interface means and therefore of the exercising user in the range of motion of the exercise stroke, and for providing a signal corresponding to the sensed position; and program means connected to the sensor means and to the variable resistance means, and including a predetermined program for controlling the variable resistance means throughout an entire exercise stroke, for receiving the varying signal of the sensor means and for converting it into a said speed reference value corresponding to a reference exercising speed which varies with user interface position, and automatically providing a series of many reference exercising speeds throughout the range of motion of each exercise stroke, for transmitting said speed reference value to said variable resistance means;

whereby, through each of the user's exercise strokes, he experiences a speed of movement which varies according to a predetermined program and according to the amount of force he applies to said user interface means.

49. A totally speed programmable variable speed exercising device, comprising:

a user interface means for accepting user exercising movement, variable resistance means connected to the user interface means, for providing a variable resistance to user movement, said resistance increasing with speed and varying with a speed reference value;

timing means operably associated with the user interface means for determining the elapsed time in motion of the interface means in an exercise stroke and for providing a signal corresponding to said elapsed time; and program means connected to the timing means and to the variable resistance means, including a predetermined program for controlling the variable resistance means throughout an entire exercise stroke, for receiving the varying signal of the timing means and for converting it into a corresponding speed reference value which varies to provide automatically a series of many different reference speeds throughout the range of motion of each exercise stroke, and for transmitting said speed reference value to said variable resistance means;

whereby, through each of the user's exercise strokes, he experiences a speed of movement which varies according to a predetermined program and according to the amount of force he applies as to said user interface means.

50. A totally speed programmable variable speed exercising device, comprising:

a user input interface means for accepting user exercising movement, variable resistance means connected to the user input interface means, for providing a variable resistance to user movement, said resistance increasing with speed and varying with a speed reference value;

measurement means operably associated with the user interface means for determining the distance moved by the interface means and therefore by the exercising user in the range of motion of the exercise stroke, and for providing a signal corresponding to the measured distance; and program means connected to the measurement means and to the variable resistance means and including a predetermined program for controlling the variable resistance means throughout an entire exercise stroke, for receiving the varying signal of the measurement means and for converting it into a corresponding speed reference value which varies to provide automatically a plurality of different reference speeds throughout the range of motion of each exercise stroke, and for transmitting said speed reference value to said variable resistance means;

whereby, through each of the user's exercise strokes, he experiences a speed of movement which varies according to a predetermined program and according to the amount of force he applies to said user interface means.

51. A totally speed programmable resistance exercising device, comprising:

a user interface means including a rotatably mounted portion;

electric generator means drivingly connected to the rotatably mounted portion of the user interface means in one direction of user interface movement, for providing resistance to user movement in the one direction, said resistance varying with speed of the generator means and an electrical load impressed thereon;

recoil means urging the user interface means toward the opposite direction of movement to retract the interface means when the user releases it;

means for providing a variable electrical load on said generator means, including means responsive to the magnitude of an input reference voltage for controlling said variable electrical load;

sensor means operably associated with the user interface means for determining the position of the interface means and therefore of the exerciser user in the range of motion of the exercise stroke in said one direction of movement, and for providing a signal corresponding to the sensed position; and program means, including a predetermined program for controlling the variable electrical load throughout an entire exercise stroke, connected to the sensor means and the variable load providing means for receiving the varying signal of the sensor, for selecting a reference voltage from said predetermined program, said reference voltage having a magnitude corresponding to a reference exercising speed which varies with user interface position, providing a series of many reference exercising speeds throughout the range of motion of each exercise stroke, and for transmitting the varying reference voltage to the variable load providing means;

whereby in each of the user's exercise strokes in said one direction of movement, he experiences, for a given speed of movement, a resistance which varies according to the predetermined program, and the user is urged to follow generally the reference exercising speed, since exceeding the reference exercising speed causes corresponding increases in resistance.

52. The exercising device of claim 51, including a rotatably mounted shaft providing a mount for said rotatable portion of the user interface means, said shaft being drivingly connected to the electric generator means in said one direction of user interface movement and also being connected to the sensor means, said recoil means being connected to the shaft to urge the user interface means toward said opposite direction of movement.

53. A programmed resistance exercising device comprising:

a user interface means including a rotatably mounted portion;

electric generator means drivingly connected to the rotatably mounted portion of the user interface means in one direction of user interface movement, for providing resistance to user movement in the one direction, said resistance varying with speed of the generator means and an electrical load impressed thereon;

recoil means urging the user interface means toward the opposite direction of movement of retract the interface means when the user releases it;

means for providing a variable electrical load on said generator means, including means responsive to the magnitude of an input reference voltage for controlling said variable electrical load;

sensor means operably associated with the user interface means for determining the position of the interface means and therefore of the exerciser user in the range of motion of the exercise stroke in said one direction of movement, and for providing a signal corresponding to the sensed position;

said sensor means including means for encoding the position of the user interface means from a zero position throughout the range of motion of the exercise stroke in said one direction, and program means, including a predetermined program, connected to the sensor means and to the variable load providing means for receiving the varying signal of the sensor, for selecting a reference voltage from a predetermined program, said reference voltage having a magnitude corresponding to a reference exercising speed which varies with user interface position, and for transmitting the varying reference voltage to the variable load proving means;

said program means including a preprogrammed memory storing digitally a series of values for reference voltage corresponding to encoded values of user interface position received from the position encoding means of the sensor, means for addressing the memory to select the appropriate reference voltage value for each user interface position; and a digital to analog converter receiving digital signals from the memory and converting them to analog signals and including means for converting the analog signals into a reference voltage of variable magnitude corresponding to the value selected from the memory, whereby in the user's exercising stroke in said one direction of movement, he experiences, for a given speed of movement, a resistance which varies according to the predetermined program, and the user is urged to follow generally the reference exercising speed, since exceeding the reference excercising speed causes corresponding increases in resistance.

54. A programmed resistance exercising device, comprising:

a user interface means including a rotatably mounted portion;

electric generator means drivingly connected to the rotatably mounted portion of the user interface means in one direction of user interface movement, for providing resistance to user movement in the one direction, said resistance varying with speed of the generator means and an electrical load impressed thereon;

recoil means urging the user interface means toward the opposite direction of movement to retract the interface means when the user releases it;

means for providing a variable electrical load on said generator means, including means responsive to the magnitude of an input reference voltage for controlling said variable electrical load;

sensor means operably associated with the user interface means for determining the position of the interface means and therefore of the exerciser user in the range of motion of the exercise stroke in said one direction of movement, and for providing a signal corresponding to the sensed position; and program means connected to the sensor means and to the variable load providing means for receiving the varying signal of the sensor, for selecting a reference voltage from a predetermined program, said reference voltage having a magnitude corresponding to a reference exercising speed which varies with user interface position, and for transmitting the varying reference voltage to the variable load proving means;

said program means having a memory storing a plurality of separately selectable programs and including means for selecting any one of the programs for use in an exercise, whereby in the user's exercising stroke in said one direction of movement, he experiences, for a given speed of movement, a resistance which varies according to the predetermined program, and the user is urged to follow generally the reference exercising speed, since exceeding the reference exercising speed causes corresponding increases in resistance.

55. A programmed resistance exercising device, comprising:

a user interface means including a rotatably mounted portion;

electric generator means drivingly connected to the rotatably mounted portion of the user interface means in one direction of user interface movement, for providing resistance to user movement in the one direction, said resistance varying with speed of the generator means and an electrical load impressed thereon;

recoil means urging the user interface means toward the opposite direction of movement to retract the interface means when the user releases it;

means for providing a variable electrical load on said generator means, including means responsive to the magnitude of an input reference voltage for controlling said variable electrical load;

sensor means operably associated with the user interface means for determining the position of the interface means and therefore of the exerciser user in the range of motion of the exercise stroke in said one direction of movement, and for providing a signal corresponding to the sensed position;

said sensor means including incremental encoder means for sensing and encoding rotation of the rotatably mounted portion of the user interface means by increments, means for sensing the direction of rotation of said portion and thus the direction of movement of the user interface means, and means for counting encoded increments of user interface means rotation in said one direction and for encoding therefrom the position of the user interface means from a zero position through the range of motion of the exercise stroke in said one direction, and program means, including a predetermined program, connected to the sensor means and to the variable load providing means for receiving the varying signal of the sensor, for selecting a reference voltage from a predetermined program, said reference voltage having a magnitude corresponding to a reference exercising speed which varies with user interface position, providing a plurality of reference exercising speeds throughout the range of motion of the exercising stroke, and for transmitting the varying reference voltage to the variable load proving means;

said program means including a preprogrammed memory storing digitally a series of values for reference voltage corresponding to encoded values of user interface position received from the position encoding means of the sensor, means for addressing the memory to select the appropriate reference voltage value for each user interface position, and a digital to analog converter receiving digital signals from the memory and converting them to analog signals and including means for converting the analog signals into a reference voltage of variable magnitude corresponding to the value selected from the memory, whereby the user's exercising stroke in said one direction of movement, he experiences, for a given speed of movement, a resistance which varies according to the predetermined program, and the user is urged to follow generally the reference exercising speed, since exceeding the reference exercising speed causes corresponding increases in resistance.

56. A totally speed programmable resistance exercising device, comprising:

a user interface means including a rotatably mounted portion;

electric generator means drivingly connected to the rotatably mounted portion of the user interface means in one direction of user interface movement, for providing resistance to user movement in the one direction, said resistance varying with speed of the generator means and an electrical load impressed thereon;

recoil means urging the user interface means toward the opposite direction of movement to retract the interface means when the user releases it;

means for providing a variable electrical load on said generator means, including means responsive to the magnitude of an input reference voltage for controlling said variable electrical load;

timing means for providing a varying signal corresponding to elapsed time commencing with the start of movement of the exercising stroke in said one direction and;

program means, including a predetermined program for controlling the variable electrical load throughout an entire exercise stroke, connected to the timing means and to the variable load providing means for receiving the varying signal of the timing means, for selecting a reference voltage from said predetermined program, said reference voltage having a magnitude corresponding to a reference exercising speed which varies with elapsed time, providing a plurality of different reference exercising speeds throughout the range of motion of the exercising stroke, and for transmitting the varying reference voltage to the variable load providing means;

whereby in the user's exercising stroke in said one direction of movement, he experiences, for a given speed of movement, a resistance which varies according to the predetermined program, and the user is urged to follow generally the reference exercising speed, since exceeding the reference exercising speed causes corresponding increases in resistance.

57. A programmed resistance exercising device, comprising:

a user interface means including a rotatably mounted portion;

electric generator means drivingly connected to the rotatably mounted portion of the user interface means in one direction of user interface movement, for providing resistance to user movement in the one direction, said resistance varying with speed of the generator means and an electrical load impressed thereon;

recoil means urging the user interface means toward the opposite direction of movement to retract the interface means when the user releases it;

means for providing a variable electrical load on said generator means, including means responsive to the magnitude of an input reference voltage for controlling said variable electrical load;

timing means for providing a varying signal corresponding to elapsed time commencing with the start of movement of the exercising stroke in said one direction, said timing means includes a clock oscillator for encoding equal increments of elapsed time from the start of movement of the exercising stroke, means for sensing the direction of movement of the user interface means, and means for counting encoded increments of elapsed time in said one direction of movement and for encoding therefrom the total elapsed time in the exercising stroke; and program means, including a predetermined program, connected to the timing means and to the variable load providing means for receiving the varying signal of the timing means, for selecting a reference voltage from a predetermined program, said reference voltage having a magnitude corresponding to a reference exercising speed which varies with elasped time, for providing a plurality of different reference exercising speeds throughout the range of motion of the exercising stroke, and for transmitting the varying reference voltage to the variable load providing means;

whereby in the user's exercising stroke in said one direction of movement, he experiences, for a given speed of movement, a resistance which varies according to the predetermined program, and the user is urged to follow generally the reference exercising speed, since exceeding the reference exercising speed causes corresponding increases in resistance.

58. The exercising device of claim 57 wherein said program means includes a preprogrammed memory storing digitally a series of values for reference voltage corresponding to encoded values of elapsed time received from the counting and encoding means, means for addressing the memory to select the appropriate reference voltage value for each value of elapsed time, and a digital to analog converter receiving digital signals from the memory and converting them to analog signals and including means for converting the analog signals into a reference voltage of variable magnitude corresponding to the value selected from the memory.

* * * * *

UNITED STATES PATENT AND TRADEMARK OFFICE

CERTIFICATE OF CORRECTION

PATENT NO. : 4,184,678

DATED : January 22, 1980

INVENTOR(S) : Evan R. Flavell, et al.

It is certified that error appears in the above-identified patent and that said Letters Patent are hereby corrected as shown below:

Column 1, line 36, "present" should read --preset--.

Column 7, line 52, "of" should read --or--.

Column 9, line 32, "ve" should read --be--.

Column 11, line 42, "controlling" should read --control--.

Column 18, line 35, "he applies as to said" should read --he applies to said--.

Column 19, line 28, "the variable" should read --to the variable--.

Column 20, line 2, "of retract" should read --to retract--.

Column 22, line 19, "whereby the user's" should read --whereby in the user's--.

Signed and Sealed this

Tenth Day of June 1980

[SEAL]

Attest:

SIDNEY A. DIAMOND

Attesting Officer

Commissioner of Patents and Trademark